US005446425A

United States Patent [19]

Banba

[11] Patent Number: 5,446,425

[45] Date of Patent: Aug. 29, 1995

[54] FLOATING POTENTIAL CONDUCTOR COUPLED QUARTER-WAVELENGTH COUPLED LINE TYPE DIRECTIONAL COUPLER COMPRISING CUT PORTION FORMED IN GROUND PLANE CONDUCTOR

[75] Inventor: Seiichi Banba, Kyoto, Japan

[73] Assignee: ATR Optical and Radio Communications Research Laboratories, Kyoto, Japan

[21] Appl. No.: 255,707

[22] Filed: Jun. 7, 1994

[30] Foreign Application Priority Data

Jun. 7, 1993 [JP] Japan ..... 5-135749

[51] Int. Cl.[6] ..... H01P 5/18

[52] U.S. Cl. ..... 333/116; 333/238

[58] Field of Search ..... 333/116

[56] References Cited

U.S. PATENT DOCUMENTS

| | | | |
|---|---|---|---|
| 3,512,110 | 5/1970 | Clar | 333/116 |
| 3,560,893 | 2/1971 | Wen | 333/116 X |
| 3,659,228 | 4/1972 | Napoli | 333/116 |
| 4,288,761 | 9/1981 | Hopfer | 333/116 |
| 4,375,054 | 2/1983 | Pavio | 333/116 |
| 4,737,740 | 4/1988 | Millican et al. | 333/116 |
| 5,008,639 | 4/1991 | Pavio | 333/116 |

FOREIGN PATENT DOCUMENTS

| | | | |
|---|---|---|---|
| 398419 | 11/1990 | European Pat. Off. | 333/116 |
| 135016 | 4/1979 | Germany | 333/116 |
| 1417083 | 8/1988 | U.S.S.R. | 333/116 |

OTHER PUBLICATIONS

"Slot-Coupled Directional Couplers Between Double-Sided Substrate Microstrip Lines and Their Applications," Tanaka et al., IEEE Trans. on Microwave Theory and Techniques, vol. 36, Dec. 1988, pp. 1752–1757.

"Multilayer MMIC Branch-Line Coupler And Broad--Side Coupler", Toyoda et al., IEEE 1992 Microwave and Millimeter-Wave Monolithic Circuits Symposium, pp. 79–82.

"A Wide-Band 3-DB Coupler With A Very Tightly Coupled Cross-Section Of Microstrip Lines", K. Sachse, Technical University of Wroclaw, Wroclaw, Poland.

*Primary Examiner*—Paul Gensler

[57] ABSTRACT

In a quarter-wavelength coupled line type directional coupler including a first dielectric layer having first and second surfaces parallel to each other, a ground plane conductor is formed on the first surface of the first dielectric layer, and two coupled microstrip conductors each having a quarter wavelength are formed on the second surface of the first dielectric layer, arranging close to each other so as to be electromagnetically coupled with each other. Further, a second dielectric layer is formed on the second surface of the first dielectric layer, on which the coupled microstrip conductors are formed, and a floating potential conductor is formed on the second dielectric layer, arranging close to the microstrip conductors so as to be electromagnetically coupled with the coupled microstrip conductors. Then a cut portion is formed in the ground plane conductor so that the ground plane conductor is separated apart from the coupled microstrip conductors by a predetermined distance.

9 Claims, 12 Drawing Sheets

Cross-section on line A-A'

Cross-section on line C-C'

Cross-section on line A-A'

Cross-section on line B-B'

Cross-section on line A-A' in case of Even mode

Cross-section on line A-A' in case of Odd mode

First modification

Second modification

Cross-section on line C-C'

Cross-section on line D-D'

Cross-section on line C-C'
in case of Even mode

Cross-section on line C-C'
in case of Odd mode

Third modification

Fourth modification

Cross-section on line E-E'

FLOATING POTENTIAL CONDUCTOR COUPLED QUARTER-WAVELENGTH COUPLED LINE TYPE DIRECTIONAL COUPLER COMPRISING CUT PORTION FORMED IN GROUND PLANE CONDUCTOR

BACKGROUND OF THE INVENTION

1. Field of the Invention

The present invention relates to a quarter-wavelength coupled line type directional coupler, and in particular, to a floating potential conductor coupled quarter-wavelength coupled transmission line type directional coupler comprising a cut portion formed in a ground plane conductor.

2. Description of the Related Art

Conventionally, directional couplers have been used when constituting a 90-degree combiner or divider. In particular, in a microwave circuit, the directional couplers are applied to various kinds of microwave circuits such as a balanced amplifier or a balanced mixer. FIGS. 17 and 18 show a conventional quarter-wavelength coupled line type directional coupler employing two microstrip lines arranged so as to be electromagnetically coupled with each other.

Referring to FIGS. 17 and 18, a ground plane conductor 12 is formed on a semiconductor substrate 11, and then, a dielectric layer 21 is formed on the ground plane conductor 12. On the dielectric layer 21, two coupled microstrip conductors 31 and 32 are formed as separated apart by a predetermined distance so as to be electromagnetically coupled with each other. In the above-mentioned structure, each of the microstrip conductors 31 and 32 has a length of a quarter wavelength, i.e., ($\frac{1}{4}$) λg (where λg is a guide wavelength) in the longitudinal direction. When analyzing the above-mentioned conventional directional coupler by a quasi-TEM approximation method (See J. Reed, et al. "A method of analysis of symmetrical four-port network" IRE Trans., MTT-4, 1968) according to the even-odd mode excitation method which is known to those skilled in the art, the directional coupler is excited with in-phase in the even mode, while it is excited with out-of-phase excitation in the odd mode. Characteristic impedances Zodd and Zeven respectively in the odd mode and even mode of the respective coupled transmission lines of the directional coupler are expressed by the following equations (1) and (2).

$$Zodd = \frac{\sqrt{\epsilon\mu}}{C_1 + 2C_{12}} \ [\Omega] \tag{1}$$

$$Zeven = \frac{\sqrt{\epsilon\mu}}{C_1} \ [\Omega] \tag{2}$$

where ε represents a dielectric constant of the dielectric layer 21, μ represents a permeability of the dielectric layer 21, $C_1$ represents an electrostatic capacity between the microstrip conductors 31 and 32 and the ground plane conductor 12, and $C_{12}$ represents an electrostatic capacity between the microstrip conductors 31 and 32.

The coupling factor K between the two microstrip lines of the conventional directional coupler can be expressed with the above-mentioned characteristic impedances Zodd and Zeven by the following equation (3).

$$K = 20\log \frac{Zeven - Zodd}{Zeven + Zodd} \ [dB] \tag{3}$$

However, since the coupling factor K expressed by the equation (3) can not be further increased in the conventional directional coupler, it is difficult to obtain specifications of the structure for achieving equal power dividing and power combining. Therefore, such directional couplers have not been often used conventionally in apparatuses which include a monolithic microwave integrated circuit (referred to as an MMIC hereinafter).

For the above-mentioned reasons, a hybrid ring employing a transmission line such as a microstrip line or the like has been widely used upon constructing a microwave circuit. However, the hybrid ring requires a large circuit area, and this results in that the microwave circuit to be implemented becomes relatively large.

In order to overcome the above-mentioned drawbacks, there has been tried to perform a method for decreasing the circuit area thereof by laminating metal conductors and thin film dielectric layers on a semiconductor substrate with a multi-layer structure and by using the resulting product as a microstrip line. However, due to use of the thin film electric insulating layer, the width of the conductor of the resulting microstrip line becomes narrow. In the case of a 90-degree hybrid ring, it is necessary to provide a transmission line having a line length of one guide wavelength λg of the frequency to be used, and therefore, the insertion loss of the transmission line increases. In other words, there have been such a drawback that neither desired power distribution nor desired synthetic or combining characteristics cannot be obtained and such a problem that the loss is increased in the MMIC employing such a hybrid ring.

SUMMARY OF THE INVENTION

An essential object of the present invention is to solve the above-mentioned problems and to provide a quarter-wavelength coupled line type directional coupler having a coupling factor larger than that of the conventional example.

According to one aspect of the present invention, there is provided a quarter-wavelength coupled line type directional coupler comprising:

- a first dielectric layer having first and second surfaces parallel to each other;
- a ground plane conductor formed on the first surface of said first dielectric layer;
- two coupled microstrip conductors each having a quarter wavelength which are formed on said second surface of said first dielectric layer, said coupled microstrip conductors being arranged close to each other so as to be electromagnetically coupled with each other;
- a second dielectric layer formed on the second surface of said first dielectric layer, on which said coupled microstrip conductors are formed;
- a floating potential conductor formed on said second dielectric layer, said floating potential conductor being arranged close to said microstrip conductors so as to be electromagnetically coupled with said coupled microstrip conductors; and a cut portion formed in said ground plane conductor so that said ground plane conductor is separated apart from said coupled microstrip conductors by a predetermined distance.

In the above-mentioned directional coupler, a space portion is preferably formed in a part of said first dielectric layer between said cut portion of said ground plane conductor and said coupled microstrip conductors.

In the above-mentioned directional coupler, the dielectric constant of said first dielectric layer is preferably set so as to be lower than the dielectric constant of said second dielectric layer.

According to a further aspect of the present invention, there is provided a quarter-wavelength coupled line type directional coupler comprising:

a dielectric layer having first and second surfaces parallel to each other;

a ground plane conductor formed on the first surface of said dielectric layer;

a cut portion formed in said ground plane conductor;

two coupled microstrip conductors each having a quarter wavelength which are formed in said cut portion on said first surface of said dielectric layer, said coupled microstrip conductor being arranged close to each other so as to be electromagnetically coupled with each other; and a floating potential conductor formed on the second surface of said dielectric layer, said floating potential conductor being arranged close to said microstrip conductors so as to be electromagnetically coupled with said coupled microstrip conductors.

According to a still further aspect of the present invention, there is provided a quarter-wavelength coupled line type directional coupler comprising:

a dielectric layer having first and second surfaces parallel to each other;

a ground plane conductor formed on the first surface of said dielectric layer;

two coupled microstrip conductors each having a quarter wavelength which are formed on the second surface of said dielectric layer, said coupled microstrip conductors being arranged close to each other so as to be electromagnetically coupled with each other;

a floating potential conductor formed in a part of said dielectric layer which is located between said coupled microstrip conductors and said ground plane conductor; and a cut portion formed in said ground plane conductor so that the ground plane conductor is separated apart, respectively, from said floating potential conductor and said coupled microstrip conductors by predetermined distances.

In the above-mentioned directional coupler, a space portion is preferably formed in a part of the dielectric layer which is located between said cut portion of said ground plane conductor and said floating potential conductor.

The above-mentioned directional coupler preferably further comprises a further dielectric layer having a dielectric constant higher than the dielectric constant of said dielectric layer, said further dielectric layer being formed on the first surface of said dielectric layer on which said coupled microstrip conductors are formed.

The above-mentioned directional coupler preferably further comprises further ground plane conductors respectively formed on both side surfaces of each of said dielectric layer and said further dielectric layer so as to be connected to said ground plane conductor.

According to a still more further aspect of the present invention, there is provided a quarter-wavelength coupled line type directional coupler comprising:

a dielectric layer having first and second surfaces parallel to each other;

a ground plane conductor formed on the first surface of said dielectric layer;

two coupled microstrip conductors each having a quarter wavelength which are formed on the second surface of said dielectric layer, said coupled microstrip conductors being arranged close to each other so as to be electromagnetically coupled with each other;

a cut portion formed in said ground plane conductor so that the ground plane conductor is separated apart from said coupled microstrip conductors by a predetermined distance; and a floating potential conductor formed on a part of the first surface of said dielectric layer which is located in said cut portion of said ground plane conductor.

The above-mentioned directional coupler preferably further comprises further ground plane conductors respectively formed on both side surfaces of each of said dielectric layer and said further dielectric layer so as to be connected to said ground plane conductor.

When substituting above-mentioned equations (1) and (2) into the equation (3), the following equation (4) representing a coupling factor K is obtained.

$$K = 20\log \frac{C_{12}}{C_1 + C_{12}} \tag{4}$$

The present inventor paid attention to the above-mentioned equation (4), and then provided in the present invention, in order to obtain a tight coupling factor K, a quarter-wavelength coupled line type four-port directional coupler having a structure for reducing the electrostatic capacity $C_1$ and for increasing the electrostatic capacity $C_{12}$.

In each of the directional couplers in accordance with the present invention having the above-mentioned construction, no line of electric force exists between the above-mentioned floating potential conductor and the two coupled microstrip conductors in the even mode, wherein the two coupled microstrip conductors have the same electric potential as each other.

With the above-mentioned arrangement, the electrostatic capacity $C_1$ between the two coupled microstrip conductors and the above-mentioned ground plane conductor can be reduced. On the other hand, in the odd mode, the floating potential conductor and the ground potential conductor have the same electric potential as each other, and at the same time, the electric potential of the floating potential conductor becomes zero, then the floating potential conductor operates as a ground plane conductor. As a result, the ground plane conductor and the two coupled microstrip conductors are put extremely close to each other, and then this increases the electrostatic capacity $C_{12}$ between the two coupled microstrip conductors. Eventually, the electrostatic capacity $C_1$ is reduced, and the electrostatic capacity $C_{12}$ is increased. This results in increase in the coupling factor K of the directional coupler as is apparent from the equation (4).

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

The following describes several preferred embodiments of quarter-wavelength coupled line type four-port directional couplers of the present invention, which are applicable to MMICs, with reference to the attached drawings.

First preferred embodiment

Figure 1:
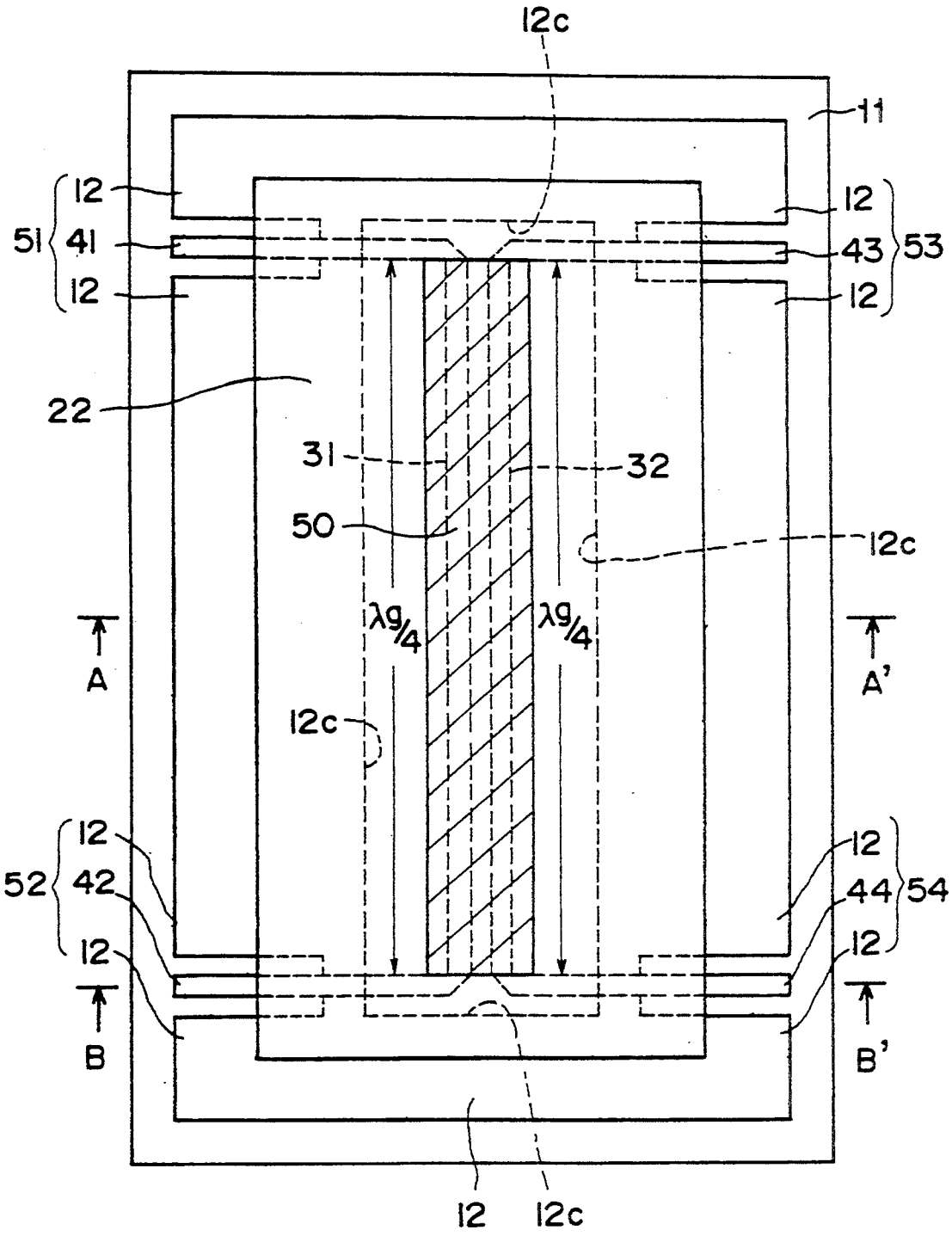
FIG. 1 is a top plan view of a quarter-wavelength coupled line type four-port directional coupler in accordance with a first preferred embodiment of the present invention.
Figure 2:
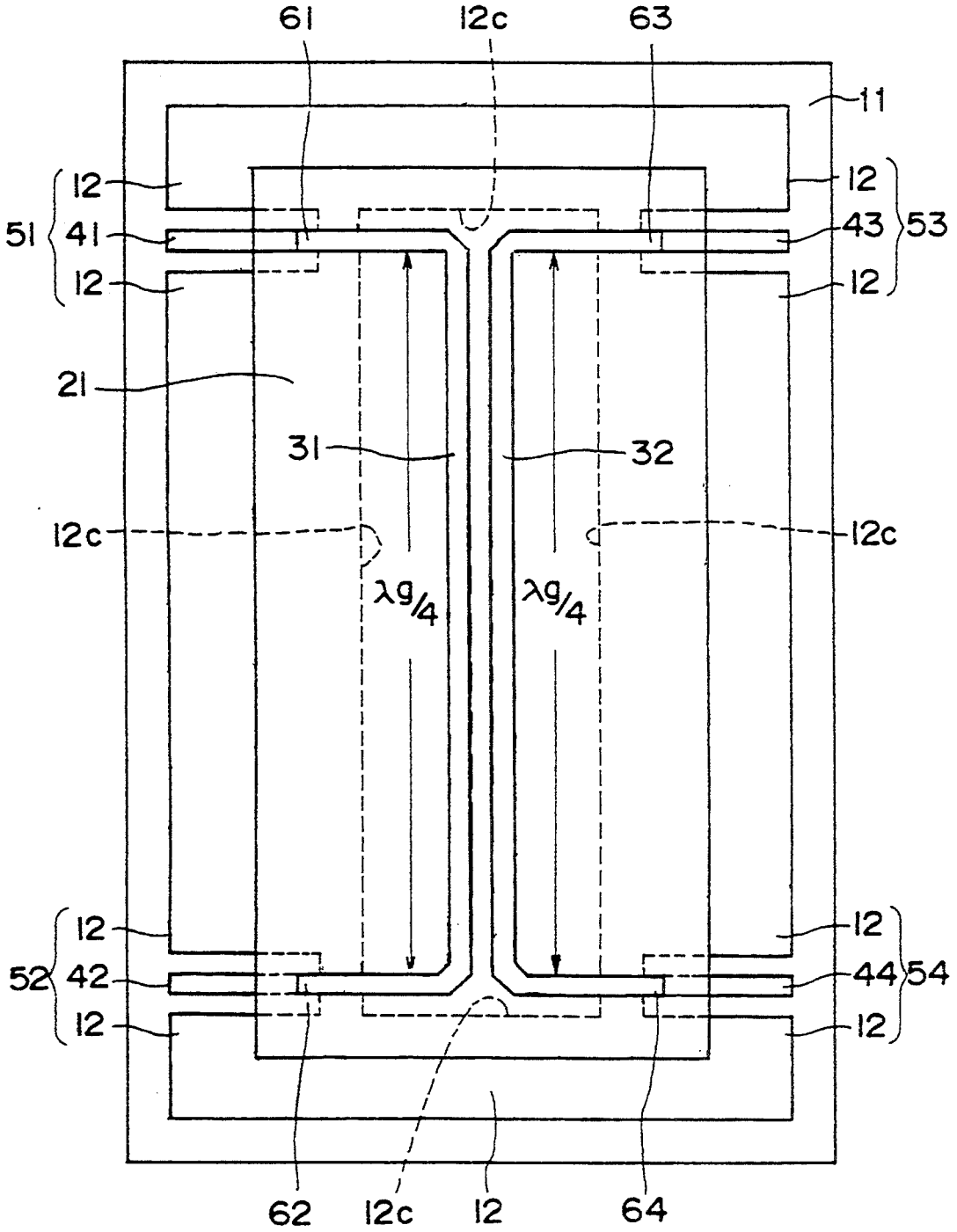
FIG. 2 is a top plan view of the directional coupler shown in FIG. 1 when both of a floating potential conductor 50 and a dielectric layer 22 are removed.
Figure 3:
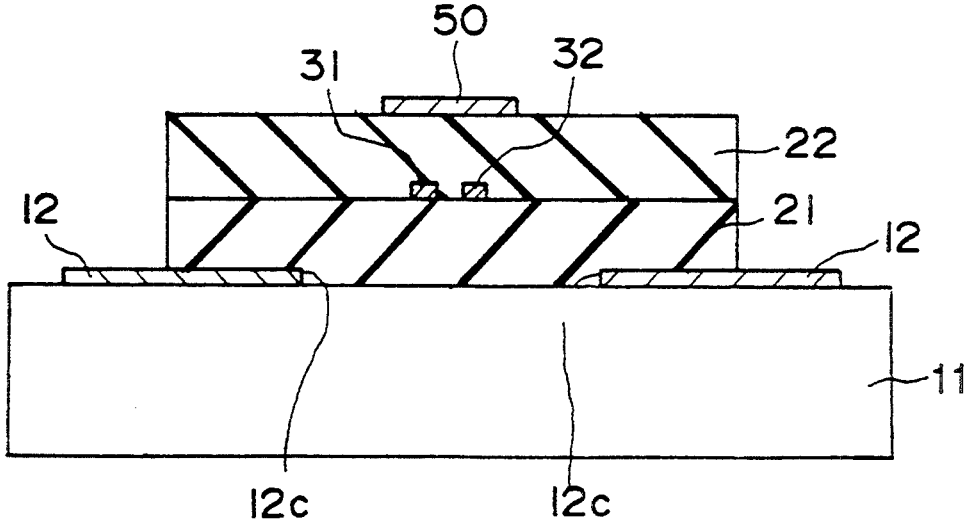
FIG. 3 is a longitudinal cross-sectional view of the directional coupler shown in FIG. 1 taken along a line A–A'.
Figure 4:
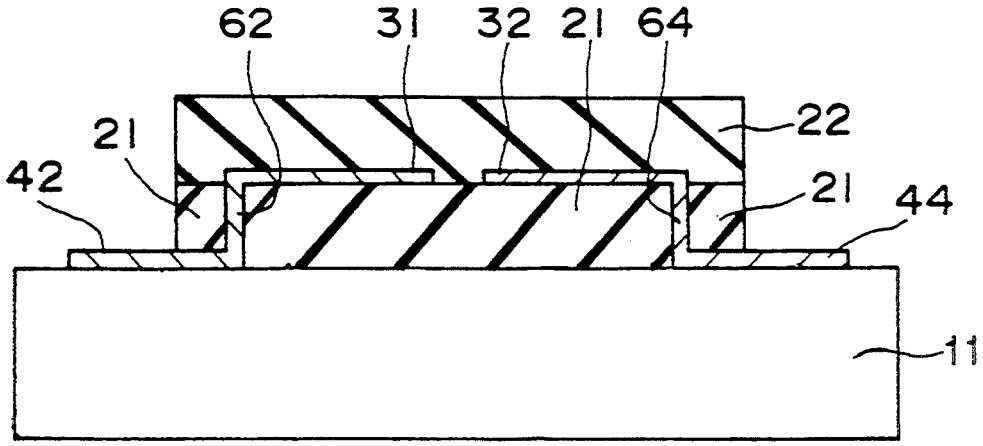
FIG. 4 is a longitudinal cross-sectional view of the directional coupler shown in FIG. 1 taken along a line B–B'.
Figure 17:
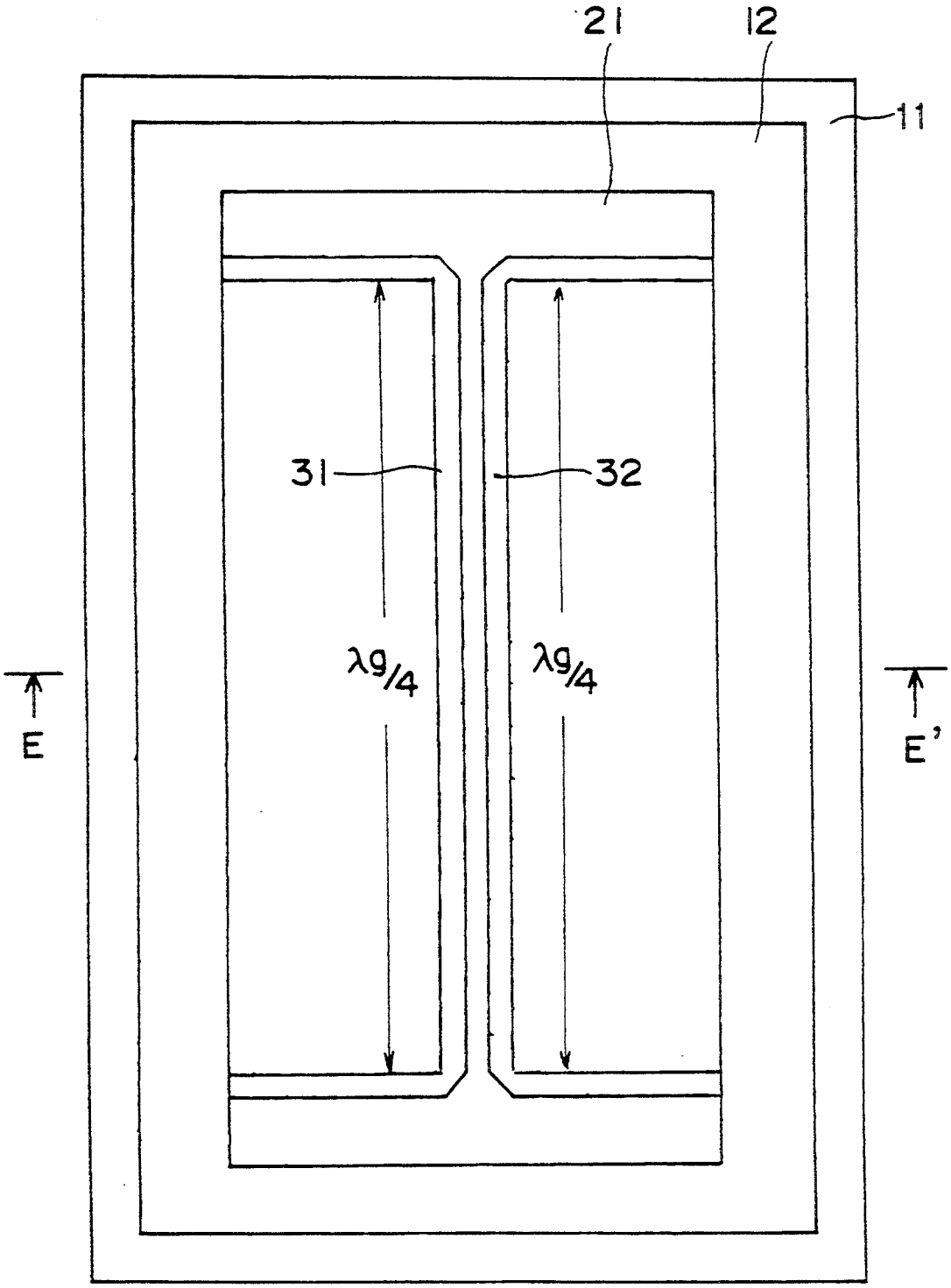
Fig. 17 PRIOR ART
FIG. 17 is a top plan view of a conventional quarter-wavelength coupled line type four-port directional coupler.
Figure 18:
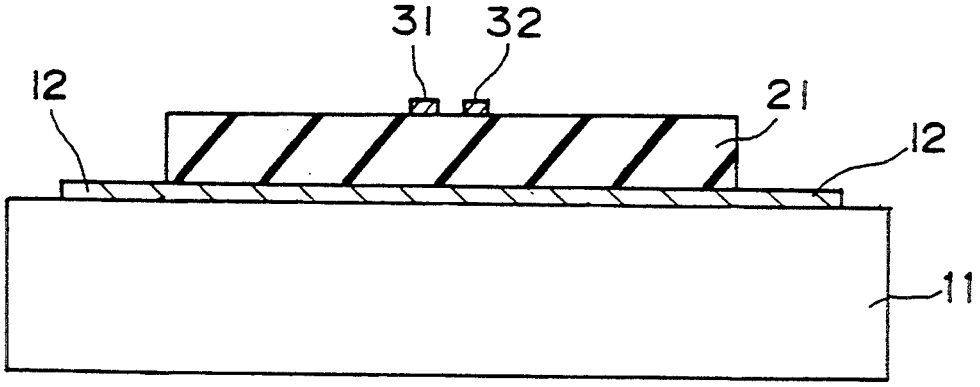
Fig. 18 PRIOR ART
FIG. 18 is a longitudinal cross-sectional view of the directional coupler shown in FIG. 17 taken along a line E–E'.

FIG. 1 is a top plan view of a quarter-wavelength coupled line type four-port directional coupler in accordance with a first preferred embodiment of the present invention, while FIG. 2 is a top plan view of the directional coupler shown in FIG. 1 when both of a floating potential conductor 50 and a dielectric layer 22 are removed. Further, FIG. 3 is a longitudinal cross-sectional view of the directional coupler shown in FIG. 1 taken along a line A–A', while FIG. 4 is a longitudinal cross-sectional view of the directional coupler shown in FIG. 1 taken along a line B–B'. In FIGS. 1 through 4, the same components as those shown in FIGS. 17 and 18 are denoted by the same numerals as those of FIGS. 17 and 18. In the top plan views of FIGS. 1 and 2, components which are invisible when viewed from the upper side are depicted by dotted lines.

As compared with the conventional directional coupler as shown in FIGS. 17 and 18, the features of the directional coupler of the first preferred embodiment are as follows. As shown in FIG. 3, the floating potential conductor 50 having a length of $\lambda g/4$ in the longitudinal direction is formed just above the coupled microstrip conductors 31 and 32 through a dielectric layer 22 on a dielectric layer 21, and further, a rectangular-shaped cut portion **12*c* is formed in the center part of a ground plane conductor 12 which is located just below the microstrip conductors 31 and 32**. Therefore, the directional coupler of the first preferred embodiment can be called a floating potential conductor coupled quarter-wavelength coupled line type four-port directional coupler.

As shown in FIGS. 1 through 4, there is formed on a semiconductor substrate 11 the ground plane conductor 12, on which the rectangular-shaped dielectric layer 21 made of an organic electrical insulating material such as polyimide resin is formed. Then coplanar waveguides 51, 52, 53 and 54 for inputting and outputting microwave signals are formed at the four corners of the semiconductor substrate 11, wherein the coplanar waveguide 51 is formed at the top left side corner, the coplanar waveguide 52 is formed at the bottom left side corner, the coplanar waveguide 53 is formed at the top right side corner, and the coplanar waveguide 54 is formed at the bottom right side corner.

The coplanar waveguide 51 is composed of a center conductor 41 and ground plane conductors 12 formed on both sides of the center conductor 41 on the semiconductor substrate 11. The coplanar waveguide 52 is composed of a center conductor 42 and ground plane conductors 12 formed on both sides of the center conductor 42 on the semiconductor substrate 11. The coplanar waveguide 53 is composed of a center conductor 43 and the ground plane conductors 12 formed on both sides of the center conductor 43 on the semiconductor substrate 11. The coplanar waveguide 54 is composed of a center conductor 44 and the ground plane conductors 12 formed on both sides of the center conductor 44 on the semiconductor substrate 11.

Further, in the center part of the ground plane conductor 12, the rectangular-shaped cut portion 12*c* is formed by, for example, the lift-off process which is well known to those skilled in the art, in an area or a part just below the two microstrip conductors 31 and 32 which are formed later. In this case, the etching process may be used instead of the lift-off process.

Further, on the dielectric layer 21, the two microstrip conductors 31 and 32 are formed so as to be separated apart by a predetermined distance, so that the longitudinal directions of the conductors are parallel to each other and the two conductors 31 and 32 are arranged close so as to be electromagnetically coupled with each other. In this case, each of the microstrip conductors 31 and 32 has a length of $(\frac{1}{4})\ \lambda g$ in the longitudinal direction. In practice, since the guide wavelength in the even mode and the guide wavelength in the odd mode are different from each other, the lengths of the microstrip conductors 31 and 32 in the longitudinal direction are set at a guide wavelength obtained by averaging both the guide wavelengths in the even and odd modes.

An end of the microstrip conductor 31 is electrically connected to the center conductor 42 through a through-hole conductor 62 provided in a first through-hole, which is formed so as to penetrate through the dielectric layer 21 in the direction of the thickness thereof as shown in FIG. 4. Another end of the microstrip conductor 31 is electrically connected to the center conductor 41 through a through-hole conductor 61 (shown in FIG. 2) provided in a second through-hole, which is formed so as to penetrate through the dielectric layer 21 in the direction of the thickness thereof in the same manner as that as described above. Further, an end of the microstrip conductor 32 is electrically connected to the center conductor 44 through a through-hole conductor 64 provided in a third through-hole, which is formed so as to penetrate through the dielectric layer 21 in the direction of the thickness thereof as shown in FIG. 4. Another end of the microstrip conductor 32 is electrically connected to the center conductor 43 through a through-hole conductor 63 (shown in FIG. 2) provided in a fourth through-hole, which is formed so as to penetrate through the dielectric layer 21 in the direction of the thickness thereof in the same manner as that as described above.

Further, the rectangular-shaped dielectric layer 22 made of the same electric insulating material as that of the dielectric layer 21 is formed on the dielectric layer 21, on which the two microstrip conductors 31 and 32 are formed as described above. On the dielectric layer 22, there is formed just above the two microstrip conductors 31 and 32, the rectangular-shaped floating potential conductor 50 which has not only two sides having a length of $(\frac{1}{4})\ \lambda g$ in the longitudinal direction in parallel with the longitudinal direction of the microstrip conductors 31 and 32 but also two sides having a predetermined width perpendicular to the longitudinal direction of the microstrip conductors 31 and 32. As a result, the directional coupler of the first preferred embodiment is obtained.

Figure 5:
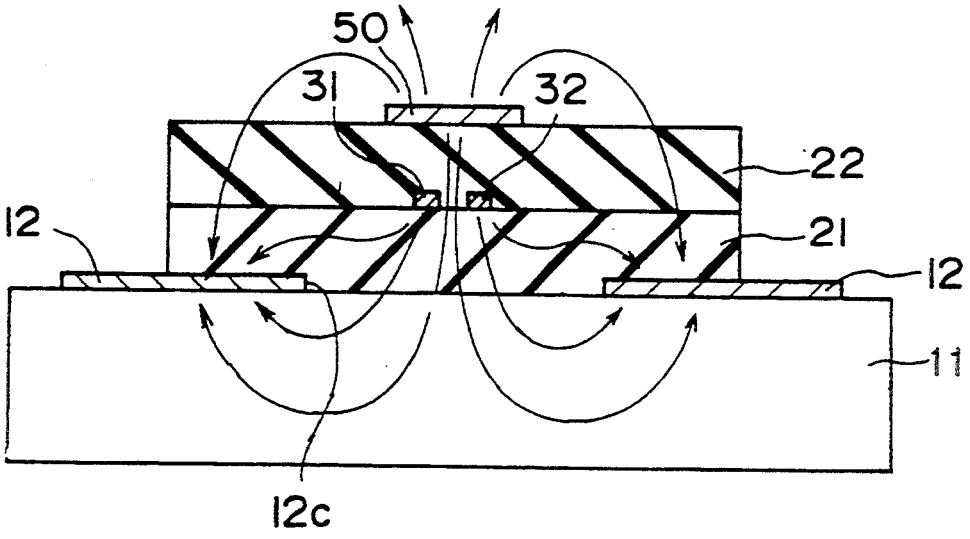
FIG. 5 is a longitudinal cross-sectional view of the directional coupler shown in FIG. 1 taken along the line A–A', showing an electric field distribution in an even mode.
Figure 6:
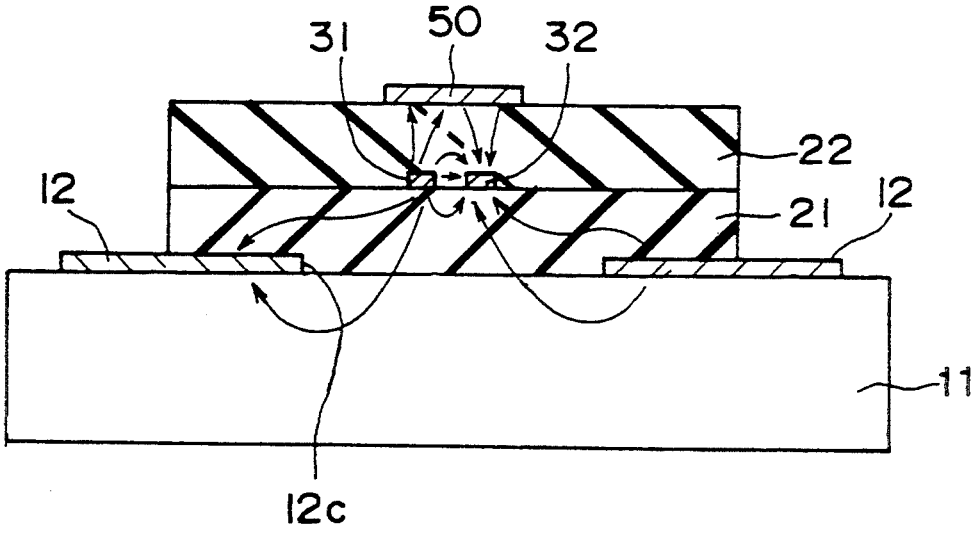
FIG. 6 is a longitudinal cross-sectional view of the directional coupler shown in FIG. 1 taken along the line A–A', showing an electric field distribution in an odd mode.

FIG. 5 is a longitudinal cross-sectional-view of the directional coupler shown in FIG. 1 taken along the line A–A′ showing an electric field distribution in the even mode, while FIG. 6 is a longitudinal cross-sectional view of the directional coupler shown in FIG. 1 taken along the line A–A′ showing an electric field distribution in the odd mode.

For the operation in the even mode as shown in FIG. 5, the cut portion 12*c* is formed in the ground plane conductor 12 just below the microstrip conductors 31 and 32, thereby reducing the electrostatic capacity $C_1$ between the ground plane conductor 12 and the microstrip conductors 31 and 32. The above arrangement is adopted for such a reason that the ground plane conductor 12 is sufficiently separated apart from the floating potential conductor 50, and therefore the possible influence of the ground plane conductor 12 on the floating potential conductor 50 can be electromagnetically ignored. As shown by the electric field distribution in FIG. 5, there exists no line of electric force between the floating potential conductor 50 and the microstrip conductors 31 and 32, and then this means that both of the conductors 31, 32 and 50 have the same electric potential as each other.

The above-mentioned fact can be easily explained from such consideration that the Kirchhoff's law does not hold since only a displacement current flows from the two microstrip conductors 31 and 32 into the floating potential conductor 50 and no current flows out because of the same electric potentials of these conductors 31, 32 and 50, if a potential difference took place between each of the two microstrip conductors 31 and 32 and the floating potential conductor 50. Therefore, the floating potential conductor 50 comes to have the same electric potential as that of the microstrip conductors 31 and 32, thereby allowing the electrostatic capacity $C_1$ to be reduced in the even mode.

On the other hand, the floating potential conductor 50 is formed on the dielectric layer 22 just above the microstrip conductors 31 and 32 for the operation in the odd mode as shown in FIG. 6. As shown in FIG. 6, there exists no line of electric force between the floating potential conductor 50 and the ground plane conductor 12, and this means that both the conductors 50 and 12 have the same electric potential as each other. Furthermore, in the same manner as the above-mentioned consideration, the electric potentials of the two microstrip conductors 31 and 32 have the same absolute value and opposite polarities in the odd mode, the electric potential of the floating potential conductor 50 is to be zero in order to satisfy the Kirchhoff's law. For the purpose to make the above-mentioned conditions hold, the floating potential conductor 50 is separated sufficiently apart from the ground plane conductor 12 so as to sufficiently suppress the influence of the ground plane conductor 12 on the floating potential conductor 50. Therefore, the electric potential of the floating potential conductor 50 is made so as to be zero, and then the floating potential conductor 50 operates as a ground plane conductor in the odd mode. As a result, the electrode distance between the ground plane conductor 12 and 50 and the microstrip conductors 31 and 32 is extremely reduced, thereby increasing the electrostatic capacity $C_{12}$.

Eventually, in the directional coupler of the first preferred embodiment, the electrostatic capacity $C_1$ is reduced by forming the cut portion 12c in the ground plane conductor 12, while the electrostatic capacity $C_{12}$ is increased by forming the floating potential conductor 50 which operates as a ground plane conductor in the odd mode. With the above-mentioned arrangement, the coupling factor K can be increased as is apparent from the above-mentioned equation (4).

In the directional coupler of the first preferred embodiment as constructed above, when, for example, the coplanar waveguide 54 is terminated with a resistive terminator (not shown) and a microwave signal is inputted to the coplanar waveguide 51, the microwave signal is outputted to the coplanar waveguide 52 through the transmission line of the microstrip conductor 31 of the directional coupler and is also outputted to the transmission line of the microstrip conductor 32, which is coupled with the microstrip conductor 31 in a tight coupling. Therefore, with the above-mentioned operation, the above-mentioned microwave signal is outputted to the coplanar waveguide 53.

It should be noted that, (a) the width of the cut portion **12*c* of the ground plane conductor 12 in the lateral direction in FIGS. 1 through 4, (b) the interval between the microstrip conductors 31 and 32, (c) the width of the microstrip conductors 31 and 32, (d) the conductor width of the floating potential conductor 50, and (e) the film thickness of the dielectric layers 21 and 22 are adjusted so as to obtain a desired coupling factor K. According to an experiment of trial production by the inventor of the present invention, when a semi-insulating GaAs substrate having a dielectric constant of 12.9 is used as the semiconductor substrate 11 and polyimide resin having a dielectric constant of 3.7 is used as the dielectric layers 21 and 22, a directional coupler having a coupling factor of 3 dB and input and output impedances of 50 Ω can be achieved by setting (a) the width of the cut portion 12*c* of the ground plane conductor 12, (b) the interval between the microstrip conductors 31 and 32, (c) the width of the microstrip conductors 31 and 32, (d) the conductor width of the floating potential conductor 50, and (e) the film thickness of the dielectric layers 21 and 22**, respectively, at (a) 112 μm, (b) 10 μm, (c) 16 μm, (d) 46 μm, (e) 7.5 μm and 2.5 μm. The above-mentioned specifications of the structure of the directional coupler can be determined by an analysis method such as finite element method or the like.

According to a process of implementing the lamination or multi-layered structure of the present preferred embodiment, each conductor can be formed by the vacuum deposition method using the lift-off technique with photoresist, while the dielectric layers 21 and 22 can be formed by subjecting an organic electric insulating material to a spin coating method. As a result, the desired structure specifications can be obtained. The above-mentioned methods are generally used in the semiconductor processing technique, and are known to those skilled in the art. Since a production accuracy of about 1 micron in dimensional accuracy of each layer and about 0.1 micron in film thickness accuracy of each layer can be easily achieved, the design accuracy of the directional coupler can be improved.

In the above-mentioned first preferred embodiment, it is preferably set so that the dielectric constant of the dielectric layer 21 is set so as to be lower than that of the dielectric layer 22. In this case, the dielectric layer 21 having a relatively low dielectric constant is interposed between the coupled microstrip conductors 31 and 32 and the floating potential conductor 50 having the same electric potential as that of the ground plane conductor 12 in the even mode, and therefore, the electrostatic capacity $C_1$ between the ground plane conductor 12 and the coupled microstrip conductors 31 and 32 is reduced. On the other hand, in the odd mode, the electric field generated between the microstrip conductors 31 and 32 and the floating potential conductor 50 is shut in or enclosed in between the dielectric layer 22 having a relatively high dielectric constant and the floating potential conductor 50, and therefore, the electrostatic capacity $C_{12}$ between the microstrip conductors 31 and 32 is increased. Therefore, the coupling factor K can be increased.

Although the floating potential conductor 50 is formed on the dielectric layer 22 just above the two microstrip conductors 31 and 32, the present invention is not limited to this. The floating potential conductor 50 is at least required to be arranged close to the two microstrip conductors 31 and 32 so that the floating potential conductor 50 is electromagnetically coupled with the microstrip conductors 31 and 32. Furthermore, the cut portion **12*c* of the ground plane conductor 12 is required to be formed so that the ground plane conductor 12 is separated apart from the microstrip conductors 31 and 32** by a predetermined distance in order to reduce the electrostatic capacity $C_1$.

Figure 7:
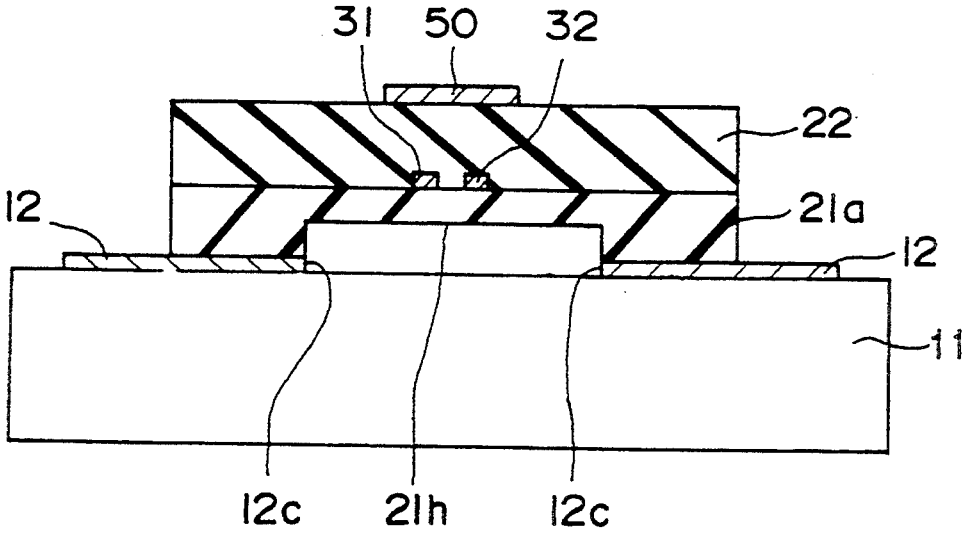
FIG. 7 is a longitudinal cross-sectional vie of a quarter-wavelength coupled line type four-port directional coupler in accordance with a first modification of the present invention, wherein FIG. 7 corresponds to the longitudinal cross-sectional view taken along the line A–A' in FIG. 1.

FIG. 7 is a longitudinal cross-sectional view of a quarter-wavelength coupled line type four-port directional coupler in accordance with a first modification of the present invention, wherein FIG. 7 corresponds to the longitudinal cross-sectional view taken along the line A–A' in FIG. 1.

As compared with the first preferred embodiment, referring to FIG. 7, a dielectric substrate **21*a* may be formed instead of the dielectric layer 21 of the first preferred embodiment, and further, a space portion or slot 21*h* may be formed in the dielectric substrate 21*a* just above the cut portion 12*c* of the ground plane conductor 12. The above-mentioned arrangement of the first modification can reduce the effective dielectric constant between the microstrip conductors 31 and 32 and the ground plane conductor 12**, and further reduces the electrostatic capacity $C_1$ as compared with that of the first preferred embodiment. This results in increase in the coupling factor K.

Figure 8:
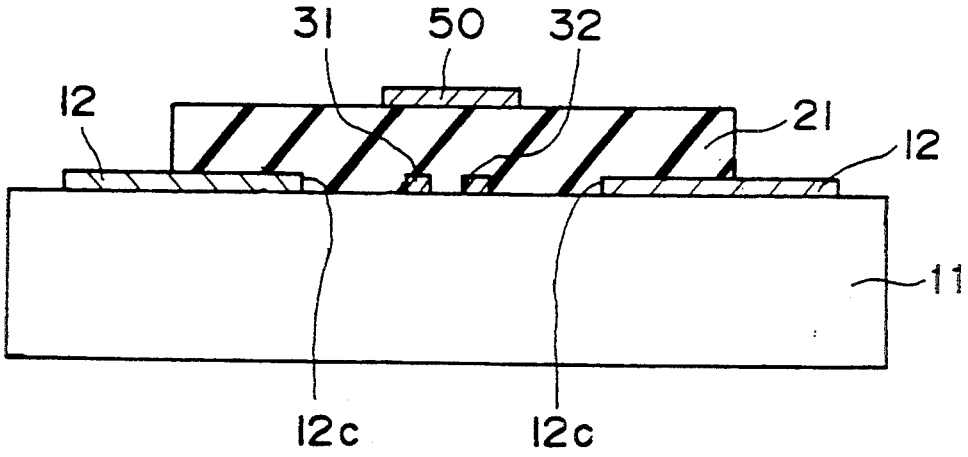
FIG. 8 is a longitudinal cross-sectional view of a quarter-wavelength coupled line type four-port directional coupler in accordance with a second modification of the present invention, wherein FIG. 8 corresponds to the longitudinal cross-sectional view taken along the line A–A' in FIG. 1.

FIG. 8 is a longitudinal cross-sectional view of a quarter-wavelength coupled line type four-port directional coupler in accordance with a second modification of the present invention, wherein FIG. 8 corresponds to the longitudinal cross-sectional view taken along the line A–A' in FIG. 1.

Referring to FIG. 8, as compared with the first preferred embodiment, the microstrip conductors 31 and 32 may be formed on the semiconductor substrate 11 in the center portion of the cut portion **12*c* of the ground plane conductor 12, and the floating potential conductor 50 may be formed on the dielectric layer 21 just above the microstrip conductors 31 and 32. In other words, in this case, a double coplanar waveguide, which is composed of the two microstrip conductors 31 and 32 and the ground plane conductors 12*c* and 12*c* located on the both sides of the two microstrip conductors 31 and 32, is formed in the line coupled portion of the second modification of the present invention. The above-mentioned arrangement, which does not include the dielectric layer 22**, can simplify the production process, and then can achieve a dimensional reduction in the second modification as compared with the first preferred embodiment.

In the above-mentioned second modification, the floating potential conductor 50 is at least required to be formed so that the floating potential conductor 50 is electromagnetically coupled with the two microstrip conductors 31 and 32.

Second preferred embodiment

Figure 9:
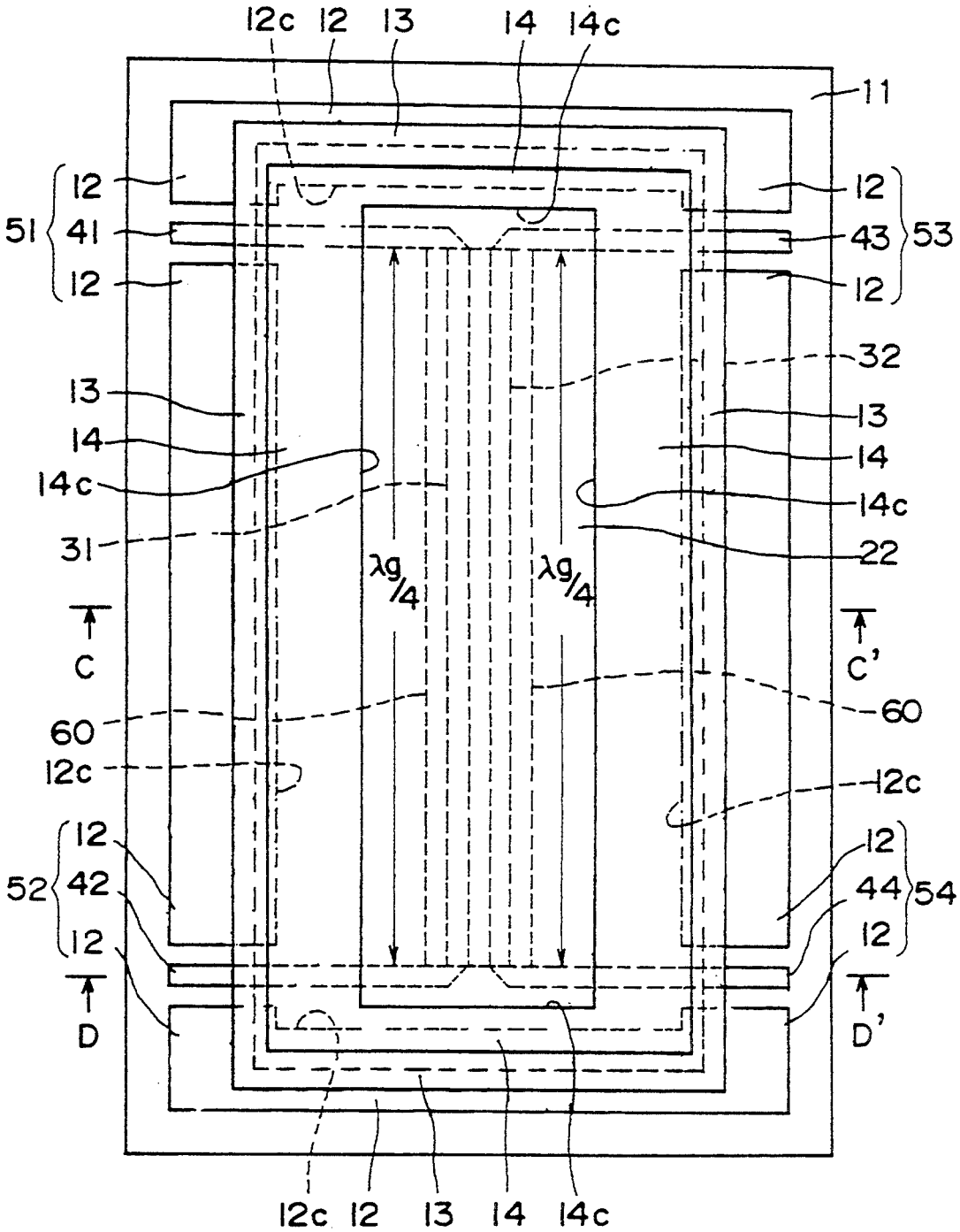
FIG. 9 is a top plan view of a quarter-wavelength coupled line type four-port directional coupler in accordance with a second preferred embodiment of the present invention.
Figure 10:
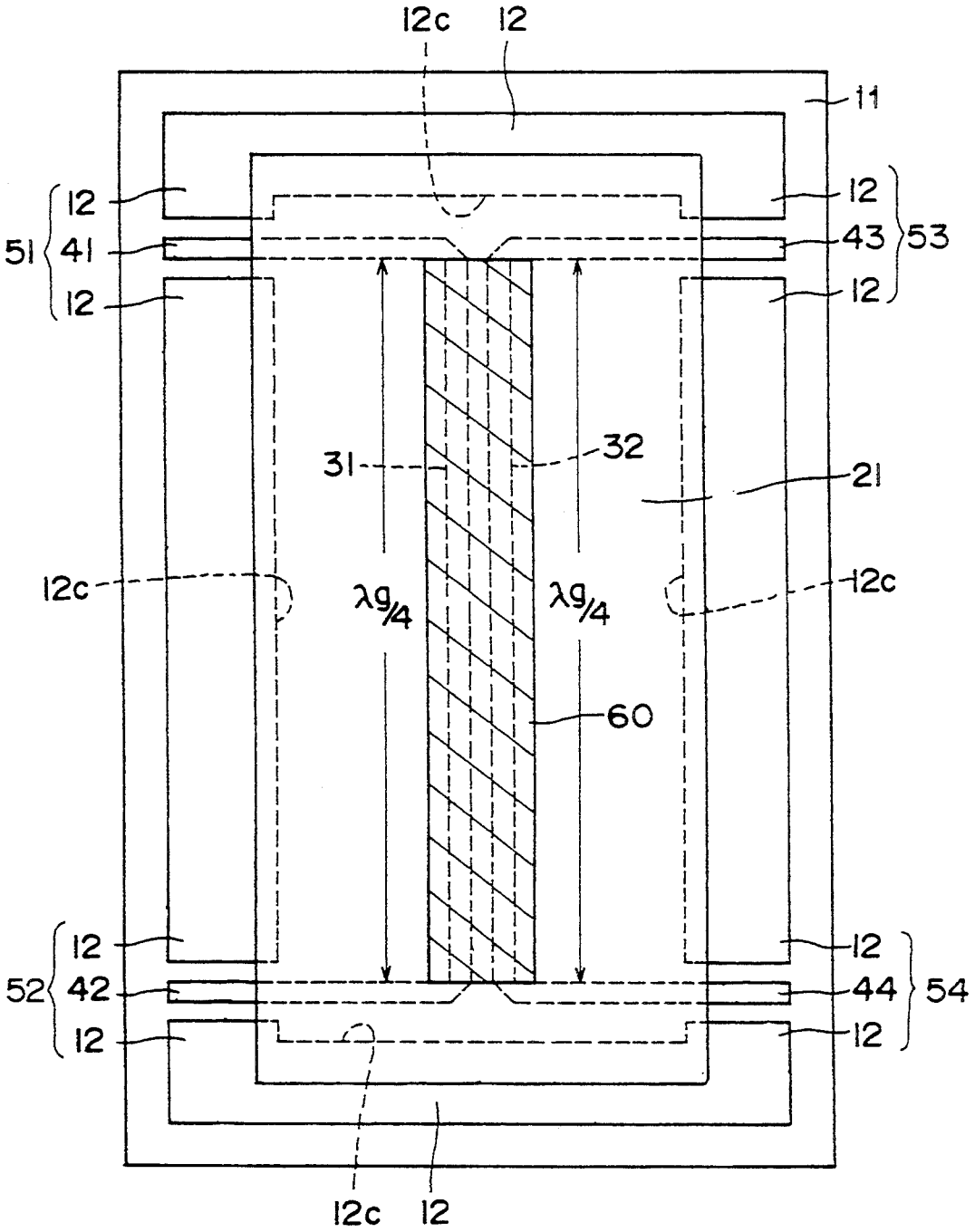
FIG. 10 is a top plan view of the directional coupler shown in FIG. 9 when both of ground plane conductors 13 and 14 and a dielectric layer 22 are removed.
Figure 11:
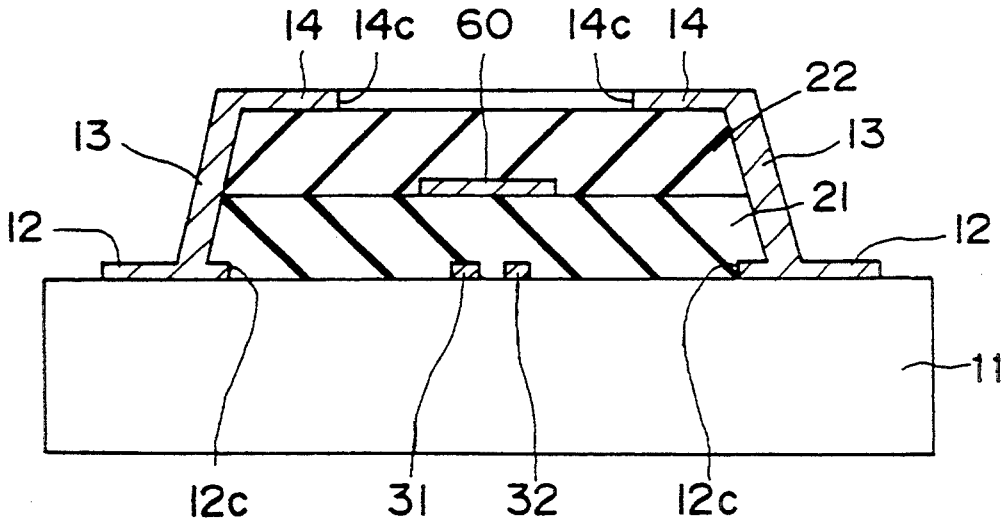
FIG. 11 is a longitudinal cross-sectional view of the directional coupler shown in FIG. 9 taken along a line C–C'.
Figure 12:
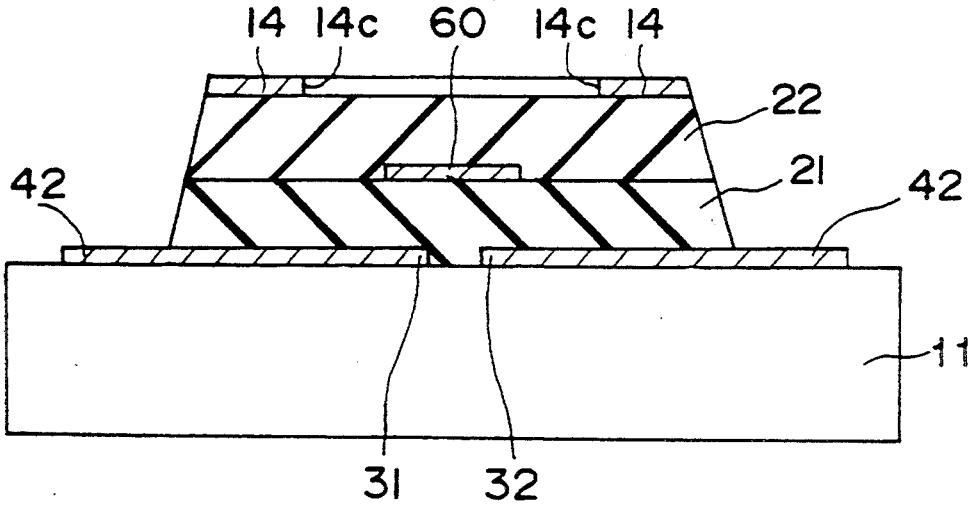
FIG. 12 is a longitudinal cross-sectional view of the directional coupler shown in FIG. 9 taken along a line D–D'.

FIG. 9 is a top plan view of a quarter-wavelength coupled line type four-port directional coupler in accordance with a second preferred embodiment of the present invention. FIG. 10 is a top plan view of the directional coupler shown in FIG. 2 when both of ground plane conductors 13 and 14 and a dielectric layer 22 are removed. FIG. 11 is a longitudinal cross-sectional view of the directional coupler shown in FIG. 9 taken along a line C–C', while FIG. 12 is a longitudinal cross-sectional view of the directional coupler shown in FIG. 9 taken along a line D–D'. Referring to FIGS. 9 through 12, the same components as those shown in FIGS. 1 through 8 and FIGS. 17 and 18 are denoted by the same reference numerals as those shown in the above Figures. In the top plan views of FIGS. 9 and 10, components which are invisible when viewed from the upper side are depicted by dotted lines.

According to the directional coupler of the second preferred embodiment, two coupled microstrip conductors 31 and 32 are formed on a semiconductor substrate 11. Further, on the microstrip conductors 31 and 32, a rectangular-shaped floating potential conductor 60 having a length of ($\frac{1}{4}$) λg in the longitudinal direction is formed just above the microstrip conductors 31 and 32 through the dielectric layer 21 formed thereon. Just above the floating potential conductor 60, a ground plane conductor 14 having a rectangular-shaped cut portion **14*c* located just above the floating potential conductor 60 is formed through the dielectric layer 22** formed thereon.

In other words, when comparing FIGS. 9 and 12 which are viewed upside down, with the conventional directional coupler shown in FIGS. 17 and 18, the directional coupler of the second preferred embodiment is characterized in that, the floating potential conductor 60 which is not connected to the ground plane conductor 14 is provided in a boundary area located between the dielectric layers 21 and 22 which are interposed between the two coupled microstrip conductors 31 and 32 and the ground plane conductor 14, and the rectangular-shaped cut portion **14*c* is formed in the ground plane conductor 14 just above (or "just below" when FIGS. 9 and 12 are viewed upside down) the floating potential conductor 60**.

The manufacturing process for the second preferred embodiment of the present invention shown in FIGS. 9 through 12 will be described below.

After a ground plane conductor 12 is formed on the semiconductor substrate 11 in a manner as shown in FIGS. 9 through 12, a rectangular-shaped cut portion **12*c* having a relatively wide area is formed by the lift-off process in the center portion of the ground plane conductor 12, wherein the width of the cut portion 12*c* is slightly smaller than that of the dielectric layer 21. In the center portion of the cut portion 12*c* on the semiconductor substrate 11, the two microstrip conductors 31 and 32 are further formed so as to be separated apart by a predetermined distance, and to be arranged parallel in the longitudinal direction and electromagnetically coupled with each other in the same manner as that of the first preferred embodiment. In this case, coplanar waveguides 51, 52, 53 and 54 for inputting and outputting microwave signals are formed in the four corners of the semiconductor substrate 11 in the same manner as that of the first preferred embodiment, and then, the coplanar waveguides 51, 52, 53 and 54 are electrically connected to the microstrip conductors 31 and 32, respectively, as follows. In a manner as shown in FIG. 10, one end of the microstrip conductor 31 is electrically connected to a center conductor 42 of the coplanar waveguide 52, while another end of the microstrip conductor 31 is electrically connected to a center conductor 41 of the coplanar waveguide 51. On the other hand, one end of the microstrip conductor 32 is electrically connected to a center conductor 44 of the coplanar waveguide 54, while another end of the microstrip conductor 32 is electrically connected to a center conductor 43 of the coplanar waveguide 53**.

Thereafter, a dielectric layer 21, which is made of an organic electric insulating material such as polyimide resin and has a rectangular surface, is formed in an area except for the input and output terminals area of the four coplanar waveguides 51 through 54 on the semiconductor substrate 11, on which the two microstrip conductors 31 and 32 are formed. Subsequently, a rectangular-shaped floating potential conductor 60 has not only two sides each having a length of ($\frac{1}{4}$) λg in the longitudinal direction as arranged in parallel with the longitudinal direction of the microstrip conductors 31 and 32 but also two sides having a predetermined width as arranged perpendicular to the longitudinal direction of the microstrip conductors 31 and 32, and the floating potential conductor 60 is formed just above the two microstrip conductors 31 and 32 on the dielectric layer 21.

Then a rectangular-shaped dielectric layer 22 made of the same electric insulating material as that of the dielectric layer 21 is formed on the dielectric layer 21 on which the floating potential conductor 60 is formed, and further, a top ground plane conductor 14 is formed on the entire surface of the dielectric layer 22. There is also formed on inclined side surfaces of the dielectric layers 21 and 22, a ground plane conductor 13 which electrically connects the top ground plane conductor 12 with the ground plane conductor 14 is formed except for the input and output terminals area of the coplanar waveguides 51 through 54 in the same process as that used for forming the ground plane conductor 14. Furthermore, the rectangular-shaped cut portion **14*c* is formed in the ground plane conductor 14 in an area just above the above-mentioned two microstrip conductors 31 and 32 and the floating potential conductor 60** by, for example, the lift-off process, and then the directional coupler of the second preferred embodiment is obtained.

Figure 13:
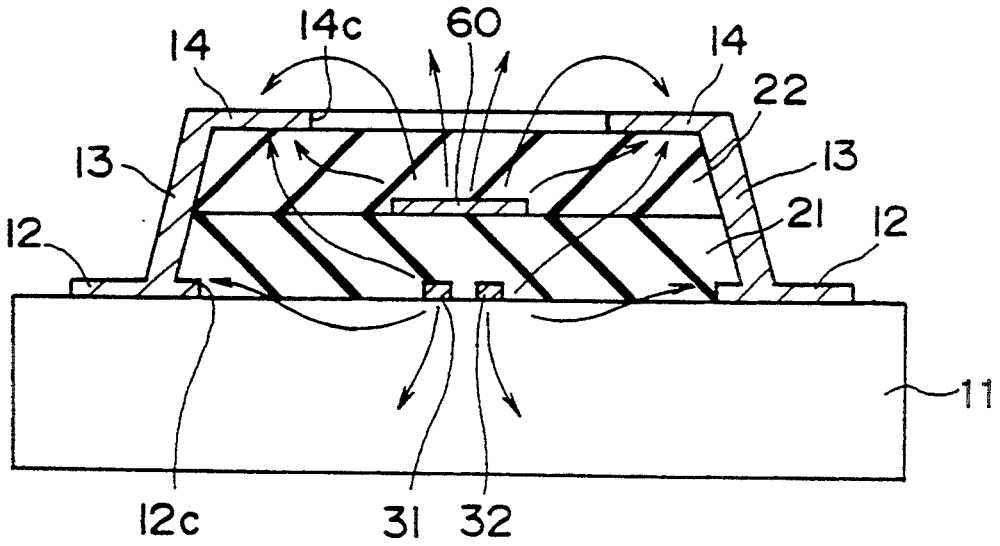
FIG. 13 is a longitudinal cross-sectional view of the directional coupler shown in FIG. 9 taken along the line C–C', showing an electric field distribution in an even mode.
Figure 14:
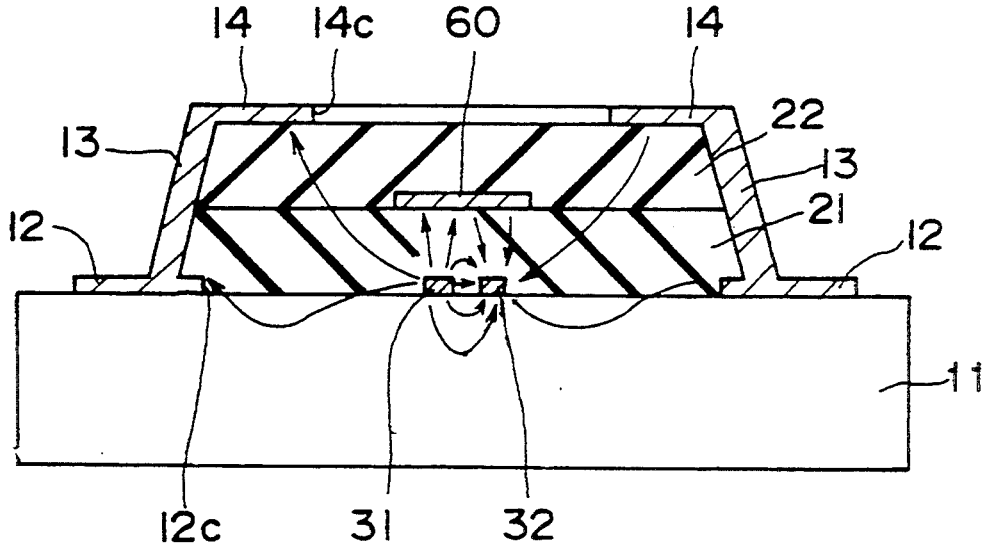
FIG. 14 is a longitudinal cross-sectional view of the directional coupler shown in FIG. 9 taken along the line C–C', showing an electric field distribution in an odd mode.

FIG. 13 is a longitudinal cross-sectional view of the directional coupler shown in FIG. 9 taken along the line C–C' showing an electric field distribution in the even mode, while FIG. 14 is a longitudinal cross-sectional view of the directional coupler shown in FIG. 9 taken along the line C–C' showing an electric field distribution in the odd mode.

As is apparent from the electric field distribution in the even mode as shown in FIG. 13, there exists no line of electric force between the floating potential conductor 60 and each of the two microstrip conductors 31 and 32, and this means that these conductors 60, 31 and 32 have the same electric potential as each other. Since the rectangular-shaped cut portion 14c is formed in the ground plane conductor 14 in the second preferred embodiment, the electrostatic capacity between the floating potential conductor 60, which has the same electric potential as that of the microstrip conductors 31 and 32, and the ground plane conductor 14 in the even mode can be reduced, and at the same time, the electrostatic capacity $C_1$ between the microstrip conductors 31 and 32 and the ground plane conductors 12, 13 and 14 can be reduced.

On the other hand, as is apparent from the electric field distribution in the odd mode as shown in FIG. 14, there exists no line of electric force between the floating potential conductor 60 and the ground plane conductor 14, and this means that the conductors 60 and 14 have the same electric potential as each other. Therefore, since the electric potential of the floating potential conductor 60 becomes zero so that the floating potential conductor 60 operates as a ground plane conductor in the odd mode in the second preferred embodiment, this causes the electrode distance between the ground plane conductor and the microstrip conductors 31 and 32 to be remarkably reduced, thereby increasing the electrostatic capacity $C_{12}$.

In other words, according to the second preferred embodiment, the electrostatic capacity $C_1$ is reduced by forming the cut portion 14c in the ground plane conductor 14, and the electrostatic capacity $C_{12}$ is increased by forming the floating potential conductor 60 which operates as a ground plane conductor in the odd mode. With the above-mentioned arrangement of the second preferred embodiment, the coupling factor K can be increased as is apparent from the above-mentioned equation (4).

In the thus constructed second preferred embodiment, when a microwave signal is inputted to the coplanar waveguide 51 while terminating, for example, the coplanar waveguide 54 with a resistive terminator (not shown), the microwave signal is outputted to the coplanar waveguide 52 through the transmission line of the microstrip conductor 31 of the directional coupler, and also is outputted to the transmission line of the microstrip conductor 32 which is coupled with the microstrip conductor 31 in a tight coupling. With the above-mentioned operation, the above-mentioned microwave signal is outputted to the coplanar waveguide 53.

The process for implementing the lamination or multi-layered structure of the second preferred embodiment can be the same as that of the first preferred embodiment.

In the second preferred embodiment described as above, it is preferred to set the dielectric constant of the semiconductor substrate 11 so as to be higher than the dielectric constant of the dielectric layers 21 and 22. With the above-mentioned arrangement, the dielectric layers 21 and 22 having a relatively low dielectric constant are arranged so as to be interposed between the two microstrip conductors 31 and 32, and each of the ground plane conductor 14 and the floating potential conductor 60 which is made so as to have the same electric potential as that of the ground plane conductor 14 in the even mode, and therefore, the electrostatic capacity $C_1$ between the ground plane conductor and the microstrip conductors 31 and 32 is further reduced. On the other hand, in the odd mode, since the electric field generated between the microstrip conductors 31 and 32 and the floating potential conductor 60 is shut in or enclosed in the space between the semiconductor substrate 11 having a relatively high dielectric constant and the floating potential conductor 60, the electrostatic capacity $C_{12}$ between the microstrip conductors 31 and 32 is further increased. Therefore, the coupling factor K can be further increased.

Although the floating potential conductor 60 is formed just above the two microstrip conductors 31 and 32 on the dielectric layer 21, the present invention is not limited to this. The floating potential conductor 60 is at least required to be formed close to the two microstrip conductors 31 and 32 so that the conductors are electromagnetically coupled with each other. Furthermore, in order to reduce the electrostatic capacity $C_1$, the cut portion 14c of the ground plane conductor 14 is at least required to be formed so that the ground plane conductor 14 is separated apart by a predetermined distance, respectively, from the floating potential conductor 60 and the two microstrip conductors 31 and 32.

In order to further reduce the electrostatic capacity $C_1$, for example, the dielectric constant of the dielectric layer 22 may be preferably set so as to be smaller than the dielectric constant of the dielectric layer 21.

Figure 15:
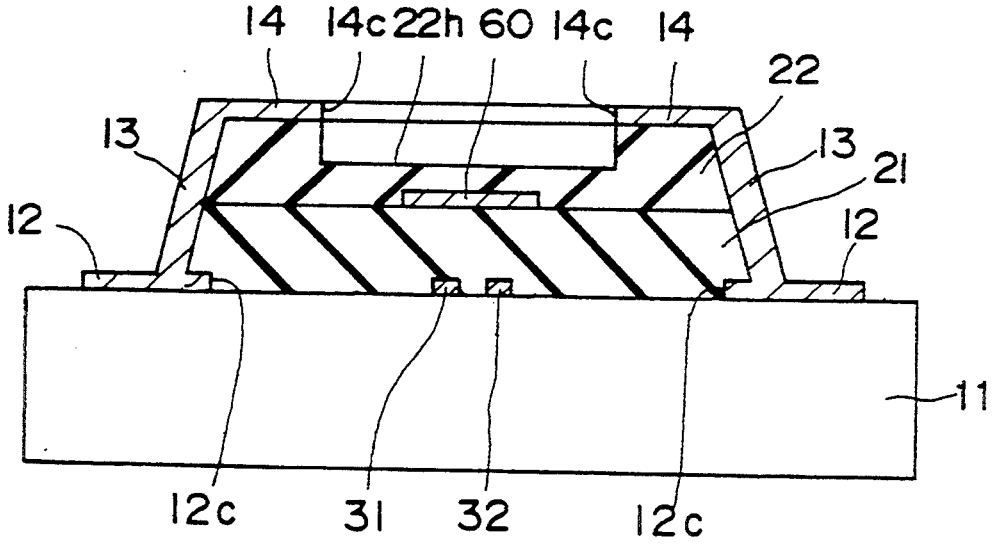
FIG. 15 is a longitudinal cross-sectional view of a quarter-wavelength coupled line type four-port directional coupler in accordance with a third modification of the present invention, wherein FIG. 15 corresponds to the longitudinal cross-sectional view taken along the line C–C' in FIG. 9.

FIG. 15 is a longitudinal cross-sectional view of a quarter-wavelength coupled line type four-port directional coupler in accordance with a third modification of the present invention, wherein FIG. 15 corresponds to the longitudinal cross-sectional view taken along the line C–C′ in FIG. 9.

Referring to FIG. 15, the dielectric layer 22 may be etched to a predetermined depth at a portion just beneath the cut portion 14c of the ground plane conductor 14, thereby forming a space portion or slot **22*h* which serves as a recess in contrast to the second preferred embodiment. With the above-mentioned arrangement of the third modification, the effective dielectric constant between the microstrip conductors 31 and 32 and the ground plane conductor 14** can be reduced, the electrostatic capacity $C_1$ is further reduced, and the coupling factor K can be increased as compared with the second preferred embodiment.

Figure 16:
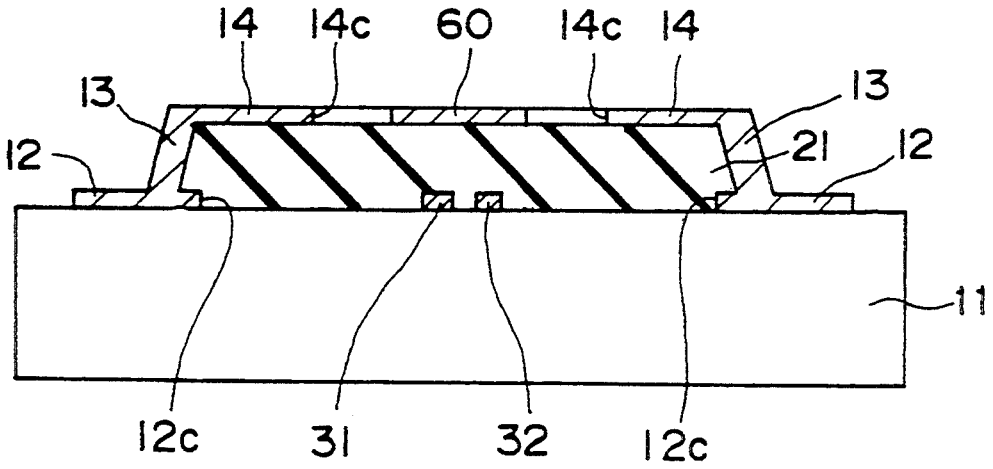
FIG. 16 is a longitudinal cross-sectional view of a quarter-wavelength coupled line type four-port directional coupler in accordance with a fourth modification of the present invention, wherein FIG. 16 corresponds to the longitudinal cross-sectional view taken along the line C–C' in FIG. 9.

FIG. 16 is a longitudinal cross-sectional view of a quarter-wavelength coupled line type four-port directional coupler in accordance with a fourth modification of the present invention, wherein FIG. 16 corresponds to the longitudinal cross-sectional view taken along the line C–C′ in FIG. 9.

Referring to FIG. 16, the dielectric layer 22 is not formed, and instead of the dielectric layer 22, the ground plane conductor 14 having the cut portion 14c in the center portion thereof may be formed on the dielectric layer 21, and further the floating potential conductor 60 may be formed in the center portion of the cut portion 14c on the dielectric layer 21. With the above-mentioned arrangement, the directional coupler of the fourth modification, which is not provided with the dielectric layer 22, allows a simplified production process and dimensional reduction as compared with the second preferred embodiment.

In the above-mentioned fourth modification, in order to reduce the electrostatic capacity $C_1$, the cut portion 14c of the ground plane conductor 14 is at least required to be separated apart from the two microstrip conductors 31 and 32 by a predetermined distance.

As described above, according to the first and second preferred embodiments and the first through fourth modifications, the electrostatic capacity $C_1$ between the ground plane conductor and the microstrip conductors 31 and 32 can be reduced, while the electrostatic capacity $C_{12}$ between the microstrip conductors 31 and 32 can be further increased. With the above-mentioned arrangement, the coupling factor K of the directional coupler can be increased. The directional couplers having the above-mentioned construction can be applied to MMICs.

Other preferred embodiments

Although the semiconductor substrate 11 is employed in each of the above-mentioned preferred embodiments, the present invention is not limited to this, and a dielectric substrate may be employed instead of the semiconductor substrate 11. In the first preferred embodiment, the dielectric layer 21 may be a dielectric substrate, and the ground plane conductor 12 may be formed on the rear surface of the layer without employing the semiconductor substrate 11. The same arrangement as above can be also applied to the first and second modifications.

In the second preferred embodiment, the dielectric layer 21 may be a dielectric substrate, and the ground plane conductor 12 and the microstrip conductors 31 and 32 may be formed on the rear surface of the layer without employing the semiconductor substrate 11. In this case, the above directional coupler may have a vertically inverted construction, or the above directional coupler may have a construction which has been turned over. The same arrangement can be also applied to the third and fourth modifications.

In each of the above-mentioned preferred embodiments, the floating potential conductors 50 and 60 are each required to have a length of at least $(\frac{1}{4})\ \lambda g$ so that the floating potential conductors 50 and 60 can operate as ground plane conductors, respectively, in the odd mode.

Although the coplanar waveguides 51 through 54 are employed for inputting and outputting microwave signals in each of the above-mentioned preferred embodiments, the present invention is not limited to this. Instead of the coplanar waveguides 51 through 54, microwave transmission lines such as microstrip lines, strip lines, tri-plate lines or the like may be employed.

According to the present invention described as above, a floating potential conductor is formed on the dielectric material or a floating potential conductor is provided in the dielectric material, and a cut portion is formed in the ground plane conductor in a conventional quarter-wavelength coupled line type four-port directional coupler. With the above-mentioned arrangement, the floating potential conductor and the two microstrip conductors are made so as to have the same electric potential in the even mode, the electrostatic capacity $C_1$ between the above-mentioned two microstrip conductors and the ground plane conductor can be reduced. On the other hand, the above-mentioned floating potential conductor and the ground plane conductor are made so as to have the same electric potential as each other in the odd mode, and at the same time, the electric potential of the floating potential conductor becomes zero so that the floating potential conductor operates as a ground plane conductor. Therefore, the electrostatic capacity $C_{12}$ between the above-mentioned two microstrip conductors is increased. Eventually, since the electrostatic capacity $C_1$ is reduced while the electrostatic capacity $C_{12}$ is increased, the coupling factor K is increased as is apparent from the above-mentioned equation (4). By virtue of the above-mentioned effects, a directional coupler having a coupling factor K higher than that of the conventional example can be provided according to the present invention.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A quarter-wavelength coupled line type directional coupler comprising:

a substrate having a predetermined dielectric constant;

a ground plane conductor having an elongated cut portion, said ground plane conductor being formed on said substrate;

a first dielectric layer having first and second surfaces parallel to each other, said first dielectric layer being formed on said ground plane conductor and said dielectric substrate so that the first surface of said first dielectric layer is in contact with said ground plane conductor and said substrate;

two mutually coupled microstrip conductors each having a longitudinal length of a quarter wavelength and a predetermined constant width, said coupled microstrip conductors being formed on said second surface of said first dielectric layer, said coupled microstrip conductors being separated from each other by a predetermined constant distance so as to be electromagnetically coupled with each other;

a second dielectric layer having first and second surfaces parallel to each other, said second dielectric layer being formed on said coupled microstrip conductors and the second surface of said first dielectric layer so that the first surface of said second dielectric layer is in contact with said coupled microstrip conductors and the second surface of said first dielectric layer; and a floating potential conductor having a longitudinal length of a quarter wavelength and a predetermined constant width, said floating potential conductor being formed on the second surface of said second dielectric layer, said floating potential conductor being arranged in relatively close proximity to said microstrip conductors so as to be electromagnetically coupled with said coupled microstrip conductors, wherein said elongated cut portion of said ground plane conductor has a longitudinal length of substantially a quarter wavelength and a predetermined constant width, and is formed so that said ground plane conductor is separated from said coupled microstrip conductors by a predetermined distance, and wherein the dielectric constant of said dielectric substrate is larger than the dielectric constants of said first and second dielectric layers, thereby increasing a coupling factor between said coupled microstrip conductors.

2. The directional coupler as claimed in claim 1, wherein the dielectric constant of said second dielectric layer is larger than that of said first dielectric layer, thereby further increasing said coupling factor.

3. The directional coupler as claimed in claim 1, wherein an elongated slot is formed in a part of said first dielectric layer between said elongated cut portion of said ground plane conductor and said coupled microstrip conductors, thereby further increasing said coupling factor.

4. The directional coupler as claimed in claim 1, wherein said substrate comprises a semiconductor substrate.

5. A quarter-wavelength coupled line type directional coupler comprising;

a substrate having a predetermined dielectric constant;

two coupled microstrip conductors each having a longitudinal length of a quarter wavelength and a predetermined constant width, said coupled microstrip conductors being formed on said substrate, said coupled microstrip conductors being mutually separated from each other by a predetermined constant distance so as to be electromagnetically coupled with each other;

a first dielectric layer having first and second surfaces parallel to each other, said first dielectric layer being formed on said coupled microstrip conductors and said substrate so that the first surface of said first dielectric layer is in contact with said coupled microstrip conductors and said substrate;

a floating potential conductor having a longitudinal length of a quarter wavelength and a predetermined constant width, said floating potential conductor being formed on the second surface of said first dielectric layer, said floating potential conductor being arranged close to said microstrip conductors so as to be electromagnetically coupled with said coupled microstrip conductors;

a second dielectric layer having first and second surfaces parallel to each other, said second dielectric layer being formed on said floating potential conductor and the second surface of said first dielectric layer so that the first surface of said second dielectric layer is in contact with said floating potential conductor and the second surface of said first dielectric layer; and a ground plane conductor having an elongated cut portion, said ground plane conductor being formed on the second surface of said second dielectric layer, wherein said elongated cut portion of said ground plane conductor has a longitudinal length of substantially a quarter wavelength and a predetermined constant width, and is formed so that said ground plane conductor is separated, respectively, from said floating potential conductor and said coupled microstrip conductors by predetermined distances, and wherein the dielectric constant of said dielectric substrate is larger than those of said first and second dielectric layers, thereby increasing a coupling factor between said coupled microstrip conductors.

6. The directional coupler as claimed in claim 5, wherein the dielectric constant of said first dielectric layer is larger than that of said second dielectric layer, thereby further increasing said coupling factor.

7. The directional coupler as claimed in claim 5, wherein an elongated slot is formed in a part of said second dielectric layer between said elongated cut portion of said ground plane conductor and said floating potential conductor, thereby further increasing said coupling factor.

8. The directional coupler as claimed in claim 5, wherein said ground plane conductor is formed so as to extend through both side surfaces of said first and second dielectric layers onto said substrate.

9. The directional coupler as claimed in claim 5, wherein said substrate comprises a semiconductor substrate.

* * * * *